US006581226B1

(12) United States Patent
Brustein

(10) Patent No.: US 6,581,226 B1
(45) Date of Patent: Jun. 24, 2003

(54) OPEN FRAME PILLOW AND HEAD SUPPORT SYSTEM

(76) Inventor: Barry B. Brustein, 131 Beach 119th St. Apt. 5D, Rockaway Park, NY (US) 11694

( * ) Notice: Subject to any disclaimer, the term of this patent is extended or adjusted under 35 U.S.C. 154(b) by 0 days.

(21) Appl. No.: 10/077,360

(22) Filed: Feb. 16, 2002

(51) Int. Cl.[7] ..... A47C 20/00
(52) U.S. Cl. ..... 5/643; 5/636
(58) Field of Search ..... 5/636, 639, 640, 5/643, 645, 490

(56) References Cited

U.S. PATENT DOCUMENTS

| | | | | | |
|---|---|---|---|---|---|
| 490,865 | A | * | 1/1893 | Dreisbach | 5/643 X |
| 1,921,984 | A | * | 8/1933 | Moore | 5/636 |
| 2,551,727 | A | * | 5/1951 | Costello | 5/643 X |
| 2,581,802 | A | * | 1/1952 | Lyons | 5/643 |
| 2,695,415 | A | * | 11/1954 | Holton | 5/643 X |
| 3,114,527 | A | * | 12/1963 | Demarest | 5/643 X |
| 4,823,776 | A | * | 4/1989 | Foster et al. | 5/643 X |
| 5,033,138 | A | * | 7/1991 | Hong | 5/636 |
| 5,337,429 | A | * | 8/1994 | Tucker | 5/643 |

* cited by examiner

*Primary Examiner*—Robert G. Santos

(57) ABSTRACT

The Open Frame Pillow & Head Support System is an apparatus which supports one's head and/or one's pillow(s) & head, and is designed with an open frame which has cantilevered upper arms which support its Head/Pillow Rest in a slightly elevated position above the resting or sleeping surface. The frame is intentionally designed to be open at its front side, opposed sides, and rear side. This design allows for one to rest comfortably in a variety of positions lying supine, prone, or on one's side while allowing for one's arm or arms to be laid or outstretched in a variety of positions comfortably underneath one's head, without the weight of the head or the weight of a pillow on which the head is resting, bearing upon the outstretched arm(s) and/or their contiguous body parts such as the shoulder(s), upper arm(s), elbow(s), forearm(s), wrist(s), hand(s). The Head/Pillow Rest can be open in the back to allow for insertion of pillows within it and when made with an elastic material at its bottom portion can support pillows of a variety of different sizes within it. It also supports a pillow on top of it. Portions of the frame can be covered with a Padded Frame Encasement for greater comfort and aesthetics, and a Pillow Slipcover can also be provided to envelop a pillow placed on top of the Head/Pillow Rest so as to contain it to the upper part of the Head/Pillow Rest.

14 Claims, 3 Drawing Sheets

OPEN FRAME PILLOW AND HEAD SUPPORT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Pillows and head supports as well as devices to help one sleep on one's side, typically either lay on the resting surface or contain portions of their body or frame which lay on the resting surface which prevent the user from the comfortable placement and movement of the arms underneath the head. Additionally, headrests do not allow for the use of a wide variety of pillows of different sizes and of the user's choice, and/or two pillows to be used simultaneously as part of its support device.

BRIEF SUMMARY OF THE INVENTION

The Open Frame Pillow & Head Support System is an apparatus which supports one's head and/or one's pillow(s) & head, and is designed with an open frame which has cantilevered upper arms. These cantilevered upper arms support the Head/Pillow Rest in a slightly elevated position above the sleeping/resting surface. The frame is intentionally left open in the front, sides, and rear between its upper and lower members so as to allow the user's arms while lying in either a supine, prone or side position, to be able to be moved and/or placed in a variety of positions underneath the elevated Head/Pillow Rest, while supporting the head and/or a pillow(s) without the weight of the pillow and/or the head bearing on the user's arm(s) and/or their contiguous body parts.

This open frame design alleviates the discomfort associated with the use of only pillows, where if one sleeps on one's side for instance, the lower elbow may either be uncomfortably bent in towards the stomach, or the arm may be uncomfortably outstretched putting pressure on the shoulder, or the arm, elbow, wrist, and hand may be placed underneath the pillow(s) where the weight of the head and the weight of the pillow(s) would bear directly upon the outstretched arm(s) and/or their contiguous body parts creating discomfort and cutting off circulation to these body parts.

Additionally, the Head/Pillow Rest can be made with its bottom material/fabric portion consisting of an elastic type material such as Spandex, which allows for a variety of pillows of different sizes to be placed within it. Pillows can also be placed on top of it and can then be covered by the Open Pillow Slipcover whose bottom layer is made of an elastic type material which stretches to envelop a pillow within it and contain it to the upper portion of Head/Pillow Rest. For additional comfort the upper arms of the frame can be padded and the other parts of the frame can be encased by the Padded Frame Encasement.

BRIEF DESCRIPTION OF THE SEVERAL VIEWS OF DRAWING

DETAILED DESCRIPTION OF THE INVENTION

Figure 1:
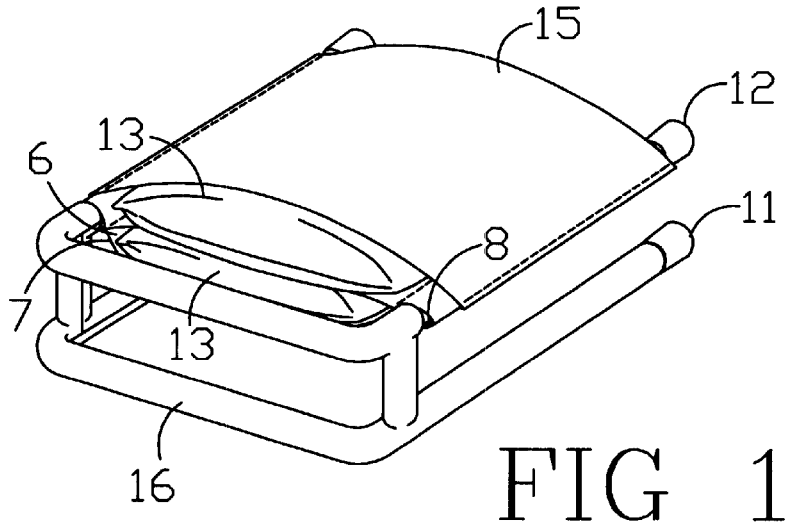
FIG. 1 shows a perspective view of the composition of all parts (shown separately in FIGS. 2, 4, 5 and 6) of the Open Frame Pillow & Head Support System being used simultaneously with a pillow inserted inside of the Head/Pillow Rest and an additional pillow resting on top of the Head/Pillow Rest, and additionally shows the use of the Open Pillow Slipcover and Padded Frame Encasement.
Figure 2:
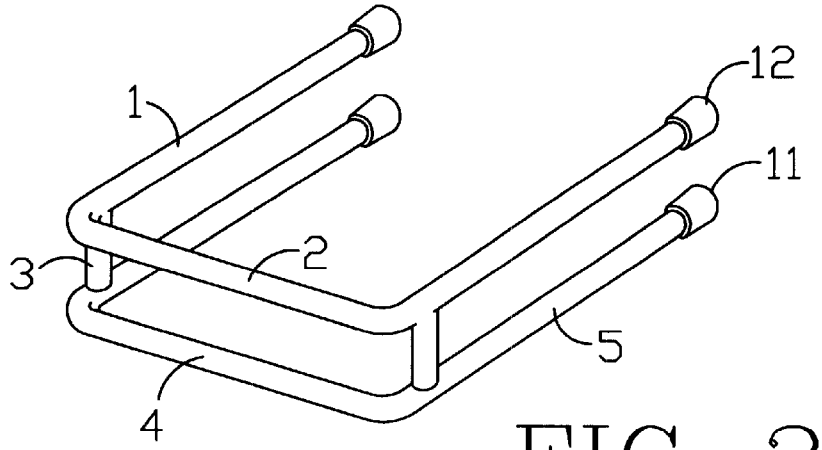
FIG. 2 shows a perspective view of the Open Frame made of a die cast molded piece or pieces(s).
Figure 3:
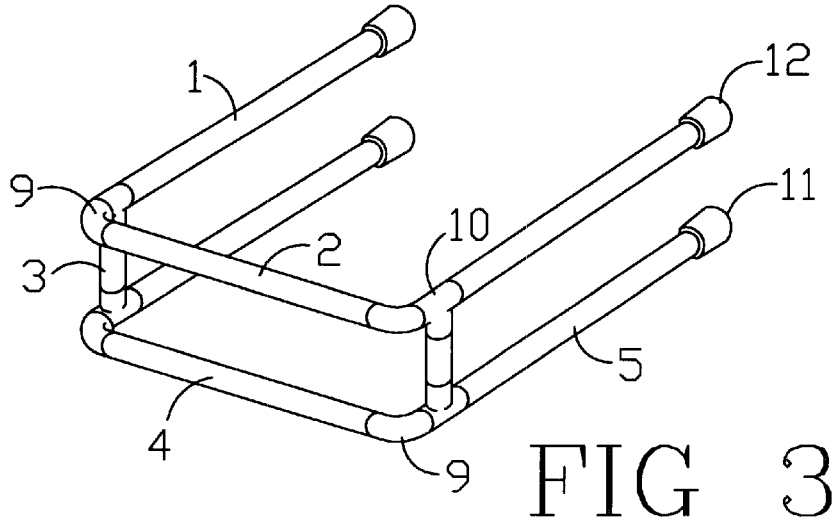
FIG. 3 shows a perspective view of the Open Frame made of pieces of PVC pipe connected and glued together to PVC elbows and PVC tee fittings.

The following is a detailed description of the components of the Open Frame Pillow & Head Support System:

Open Frame—The Open Frame which is shown in FIG. 1, FIG. 2 and FIG. 3 directly supports the Head/Pillow Rest on its upper arms 1. It can be made of PVC pipe and fittings and/or any suitable material which is either pieced together or made of die cast molded piece(s) which provide(s) the necessary support strength. It is preferable though, for the frame's material to have support strength while also having some resiliency and flexibility, to allow for some play or give in the upper arms 1 of the frame, which will provide greater comfort for the user.

The Open Frame's upper portion, which includes the upper arms 1, and an upper rear horizontal member 2, are attached to and supported by two vertical members 3, at the rear of the frame. The vertical members 3, are attached perpendicularly in the same manner at the upper and lower portions of the frame at its rear. This design allows for the upper arms 1 of the Open Frame to be cantilevered over the two vertical support members 3, and intentionally allows the Open Frame to be open in the front, back and sides.

A functional prototype as shown in FIG. 3, which has not yet been marketed at the time of this application filing, is made of sections of one half inch PVC Schedule 40 pipe, one half inch PVC 90 degree elbow fittings 9, & one half inch PVC tee fittings 10, glued together with PVC Cement. The tee fittings 10, which are stubbed to each. of the four elbows 9, support the two vertical members 3, the upper arms 1, and lower arms 5, of the frame. The elbows additionally support the upper rear horizontal member 2, and lower rear horizontal member 4, of the frame.

Vinyl or rubber tips 11, are permanently glued to the front ends of the lower arms 5, of the Open Frame to cover its edges. Removable rubber and/or padded tips 12, are placed on the front ends of the cantilevered upper arms 1, to prevent the Head/Pillow Rest from slipping off the front of the arms when in use, while facilitating easy removal of the Head/Pillow Rest from the Open Frame.

The Open Frame's upper arms 1, can be padded for greater comfort but this is not essential to the utility of the device and is therefore not depicted in the Figures provided. The other members of the Open Frame can be uniformly padded with the Padded Frame Encasement.

Figure 4:
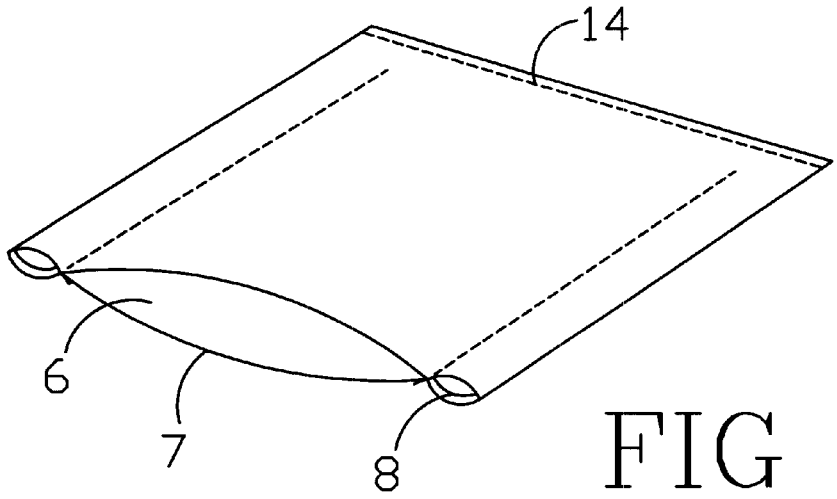
FIG. 4 shows a perspective view of the Head/Pillow Rest.

Head/Pillow Rest—The Head/Pillow Rest as shown in FIG. 1 and FIG. 4, is directly supported by the cantilevered upper arms 1, of the Open Frame. It is designed to support the head either with the use of a pillow 13, inserted inside of it, placed on top of it, placed on top and inserted inside of it as depicted in FIG. 1, or with no pillow at all. The Head/Pillow Rest is closed in the front and left open in the back 6, so as to allow for the insertion of pillows 13. The bottom layer of the material/fabric 7, can be made of an elastic type material (e.g. Spandex) to allow it to stretch for a snug fit around a variety of pillows of different sizes. The Head/Pillow Rest is made by making a single even fold of the material/fabric used, or if an, elastic material/fabric is desired so as to allow insertion of pillows of different sizes, it can be made by taking a material/fabric such as cotton to be used for the upper portion where the head would rest, and stitching it at the front 14, to the elastic material/fabric to be used as the bottom layer 7. The front stitching 14, is only required when an elastic material/fabric is to be used as the bottom layer 7, and connected to a different upper material fabric. The material(s)/fabric(s) used are then folded and stitched at both sides to create loops 8. These loops 8, allow for the Head/Pillow Rest to be easily slid on and off the cantilevered upper arms 1, of the Open Frame. The Head/Pillow Rest when used with a pillow 13, placed on top, can be enveloped within the Open Pillow Slipcover 15, for greater comfort while achieving a better aesthetic appearance.

Figure 5:
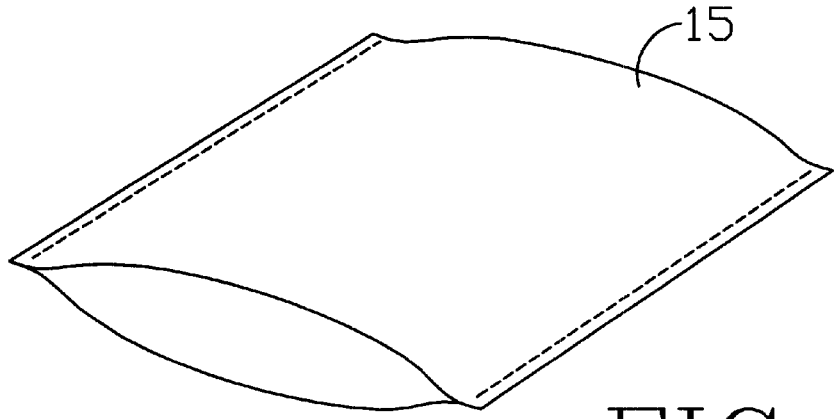
FIG. 5 shows a perspective view the Open Pillow Slipcover.

Open Pillow Slipcover—The Open Pillow Slipcover 15, as shown in FIG. 1 and FIG. 5, acts as a pillow case which can be used to cover a pillow placed upon the Head/Pillow Rest by simultaneously enveloping the Head/Pillow Rest, the cantilevered upper arms 1, of the Open Frame and a pillow 13, placed on top of the Head/Pillow Rest, as well as a pillow 13, placed within it, so as to contain the top pillow 13, to the upper part of the Head/Pillow Rest.

The Open Pillow Slipcover 15, has its upper and lower material(s)/fabric(s) stitched closed at both sides and left open in the front and back to allow it to be slid on and off. The bottom layer of the Open Pillow Slipcover 15, is made of an elastic type material (e.g. Spandex) to allow it to stretch for a snug fit around a variety of pillows of different sizes.

Figure 6:
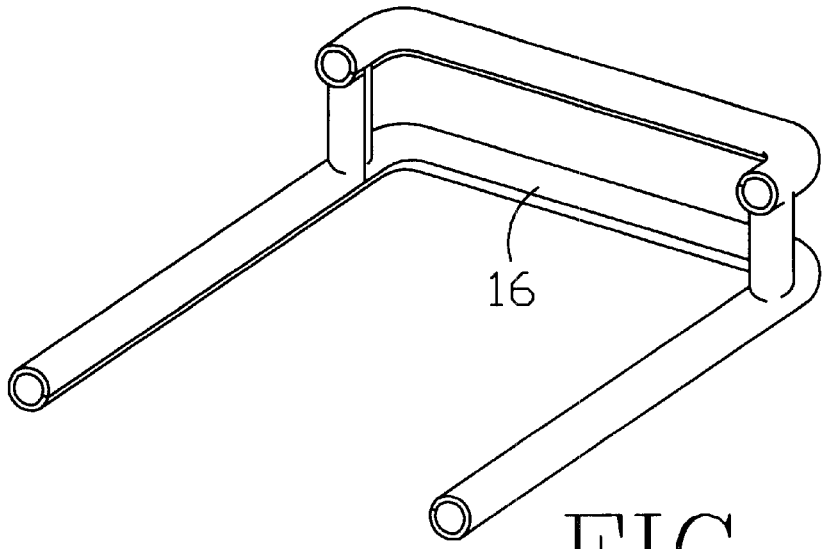
FIG. 6 shows a perspective view of the Padded Frame Encasement.
Figure 7:
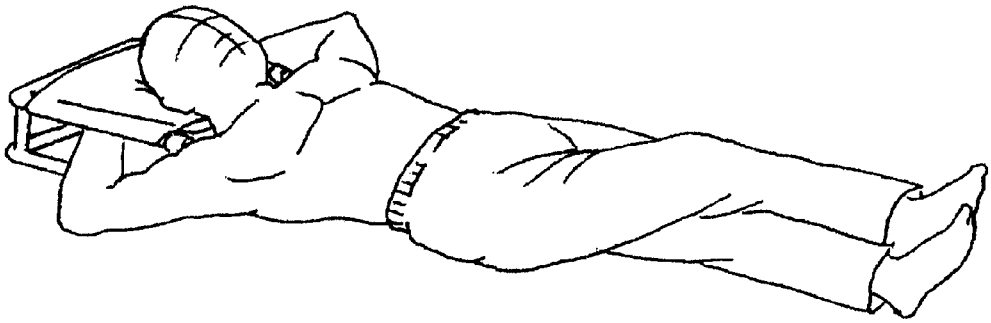
FIG. 7 shows a perspective view of a person using the Open Frame and Head/Pillow Rest while lying in supine position and depicts portions of the user's arms resting underneath the Head/Pillow Rest.
Figure 8:
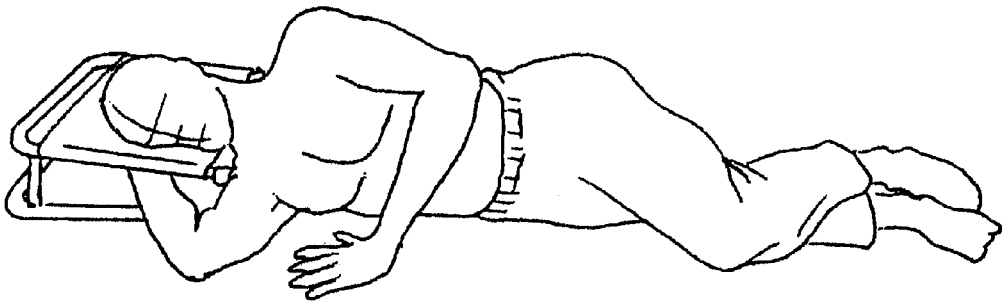
FIG. 8 shows a perspective view of a person using the Open Frame and Head/Pillow Rest while lying in a side position and depicts a portion of the user's lower arm resting underneath the Head/Pillow Rest.
Figure 9:
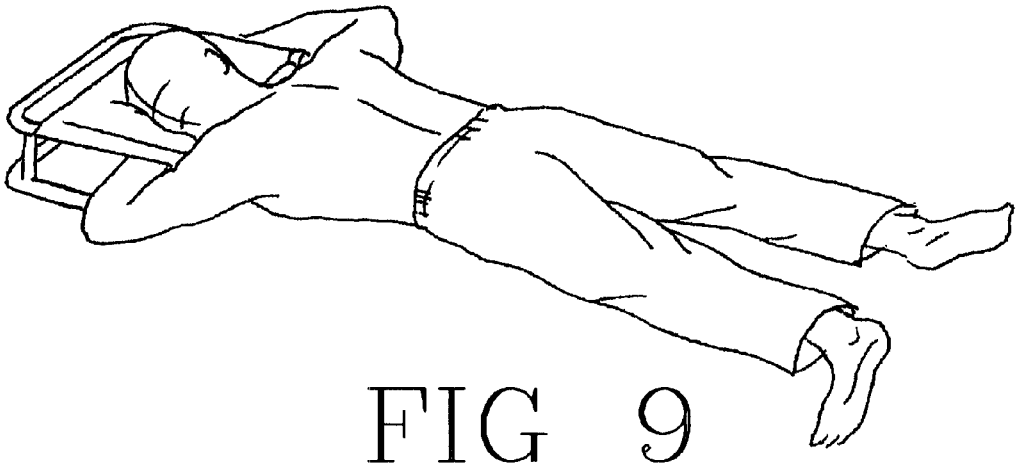
FIG. 9 shows a perspective view of a person using. the Open Frame and Head/Pillow Rest while lying in a prone position and depicts portions of the user's arms resting underneath the Head/Pillow Rest.

Padded Frame Encasement—The Padded Frame Encasement 16, as shown in FIG. 1 and FIG. 6 is a removable fitted foam type and/or material covering which can be used to uniformly pad the Open Frame's upper rear horizontal support member 2, its lower rear horizontal support member 4, its lower arms 5, and its vertical support members 3, for greater comfort while achieving a better aesthetic appearance. The padding is split and/or hollowed out at its inside areas so that it form fits around the above-mentioned portion's of the Open Frame which it is intended to cover.

What I claim as my invention is the following:

1. An open frame and body support system comprising, in combination, a supporting frame and a body support, said supporting frame consisting essentially of a pair of elongated lower arms being formed coplanar on opposed sides of an imaginary vertical centerline plane, each of said lower arms having a front terminal end and a rear portion, and a lower connecting member connecting said rear portions of said lower arms thereby forming a lower supporting frame for placement on a supporting surface, at least one upwardly extending member arising from the rear portion of said lower supporting frame, a pair of elongated upper arms being formed coplanar on opposed sides of said imaginary vertical centerline plane, each of said upper arms having a front terminal end and a rear portion, and an upper connecting member connecting said rear portions of said upper arms thereby forming an upper supporting frame, the rear portion of said upper supporting frame being connected to the upper extent of said at least one upwardly extending member thereby creating said supporting frame that is open in at least the front and opposed sides thereof, said body support being secured to said pair of upper arms and traversing the open space there between, whereby a user can rest in a variety of positions while being supported by said body support while allowing the user's upper body limbs to rest or move unobtrusively there under.

2. The system of claim 1, wherein said body support includes loops on opposed sides thereof for securement to said pair of upper arms.

3. The system of claim 1, wherein said body support is composed of at least one layer of fabric.

4. The system of claim 1, wherein said body support is composed of at least two layers of fabric in the form of a slip adapted to receive a pillow.

5. The system of claim 4, wherein at least one layer of fabric is composed of an elastic material.

6. The system of claim 1, further including a slipcover secured to the upper arms and substantially surrounding said body support, said slipcover being open at its front and back sides and containing a bottom layer composed of an elastic material.

7. The system of claim 1, further including removable padding covering at least said upper and lower connecting members, said elongated lower arms and said at least one upwardly extending member.

8. The system of claim 7, wherein said removable padding is a one piece, unitary construction.

9. The system of claim 1, wherein said supporting frame is made from a plurality of PVC piping and PVC fittings connected together.

10. The system of claim 1, wherein said supporting frame is made as a single, one piece molding of PVC.

11. The system of claim 1, wherein said supporting frame is made of a combination of single molded PVC pieces and PVC piping and PVC fittings connected together.

12. The system of claim 1, wherein said supporting frame includes two upwardly extending members positioned at the rear portion of said supporting frame and each rising from opposed sides of said rear portion of said lower supporting frame.

13. The system of claim 1, further including tips made of soft material located on at least said front terminal ends of said upper arms of said upper supporting frame.

14. The system of claim 1, further including a soft material padding substantially covering said upper arms.

* * * * *